US005827000A

United States Patent [19]

Andrews

[11] Patent Number: 5,827,000

[45] Date of Patent: Oct. 27, 1998

[54] WRITING INSTRUMENT

[75] Inventor: Neville Edgar Andrews, Horsham, England

[73] Assignee: Parker Pen Products, Isleworth, England

[21] Appl. No.: 718,410

[22] PCT Filed: Apr. 6, 1995

[86] PCT No.: PCT/GB95/00796

§ 371 Date: Nov. 20, 1996

§ 102(e) Date: Nov. 20, 1996

[87] PCT Pub. No.: WO95/27626

PCT Pub. Date: Oct. 19, 1995

[30] Foreign Application Priority Data

Apr. 7, 1994 [GB] United Kingdom ..... 9406837

[51] Int. Cl.[6] ..... A43K 21/22

[52] U.S. Cl. ..... 401/65

[58] Field of Search ..... 401/49, 55, 65

[56] References Cited

U.S. PATENT DOCUMENTS

| | | | |
|---|---|---|---|
| 4,620,811 | 11/1986 | Kageyama | 401/65 |
| 4,969,763 | 11/1990 | Kageyama et al. | 401/65 X |
| 4,998,837 | 3/1991 | Kageyama et al. | 401/65 X |
| 5,052,838 | 10/1991 | Tucker | 401/65 |
| 5,509,743 | 4/1996 | Hao | 401/65 |

FOREIGN PATENT DOCUMENTS

0553011A1 7/1993 France .

*Primary Examiner*—William E. Stoll

*Attorney, Agent, or Firm*—Chester Cekala; David A. Howley

[57] ABSTRACT

A modular lead advancing mechanism receivable as an integral unit in a mechanical pencil. The mechanism includes a lead feed for feeding a pencil lead out of a pencil, and a force transmitter for transmitting a force from an operating button on the pencil to operate the lead feed.

9 Claims, 2 Drawing Sheets

WRITING INSTRUMENT

The present invention relates to writing instruments and more particularly to a modular mechanism for advancing the lead of a mechanical pencil.

Conventional mechanical pencils have a mechanism by means of which the pencil lead can be extended and retracted selectively by the user, often by depressing or twisting a button at the end of the pencil opposite the writing tip end. A drawback with conventional mechanical pencils of this type is that the mechanism can only take one particular size of pencil lead, for example 0.5 mm or 1 mm. There is generally no simple means by which the user can alter the pencil so that it can take a lead of a different size. If the user wishes to adapt the mechanical pencil to take a pencil lead of a different size, the user must disassemble the mechanism, which can be troublesome since reassembly requires that various springs and other components must be assembled in the correct order, and such components are often relatively small.

According to the present invention, there is provided a modular lead advancing mechanism receivable as an integral unit in a mechanical pencil, the mechanism having a lead feed for feeding a pencil lead out of a pencil, and force-transmitting means for transmitting a force from an operating button on the pencil to operate the lead feed.

The modular pencil mechanism can be simply fitted into a suitable pencil barrel adapted to receive the modular pencil mechanism. There are no loose components so that the user can easily change modules in order to be able to use pencil leads of a different size.

The modular pencil mechanism may have an outer sleeve having an external flange. The sleeve further may contain the operating parts of the mechanism, for example, the various springs, the lead feed clutch, etc. The external flange on the outer sleeve generally cooperates with a bearing surface within the barrel of an assembled pencil to provide support for the mechanism within the pencil barrel.

The force-transmitting means may be a lead guide which extends from, and is slidably movable within, the outer sleeve, the lead guide having a flange at its end opposite the writing tip end of the modular pencil mechanism. In an assembled pencil, the flange contacts a flange connected to the operating button of the mechanical pencil.

The mechanism may have a clutch for gripping the pencil lead, the clutch being fixed to, or integral with, the lead guide, there being a clutch band disposed around the clutch. Resilient means, for example a coil spring under compression, may be provided to act between the clutch band and the lead guide in order normally to tighten the clutch around the pencil lead.

Resilient means, such as a cushioning spring, may be provided to absorb shocks during writing or if the mechanical pencil in which the mechanism is fixed should be dropped on the writing tip end.

The present invention also includes a mechanical pencil structure having a modular pencil mechanism as described above.

Where the modular mechanism has an outer sleeve having an external flange, the pencil structure may have an internal annular recess which receives the flange. The pencil may have a tip portion removably fixed to a barrel, the tip portion being removable in order to allow the modular mechanism to be removed.

The pencil may have a button which may be depressed or twisted in order to forward or retract the pencil lead. Where the mechanism has a lead guide, depression or twisting of the button may cause the lead guide to be pushed forward within the mechanism in order to extend the pencil lead.

An example of the present invention will now be described with reference to the accompanying drawing, in which.

Figure 1:
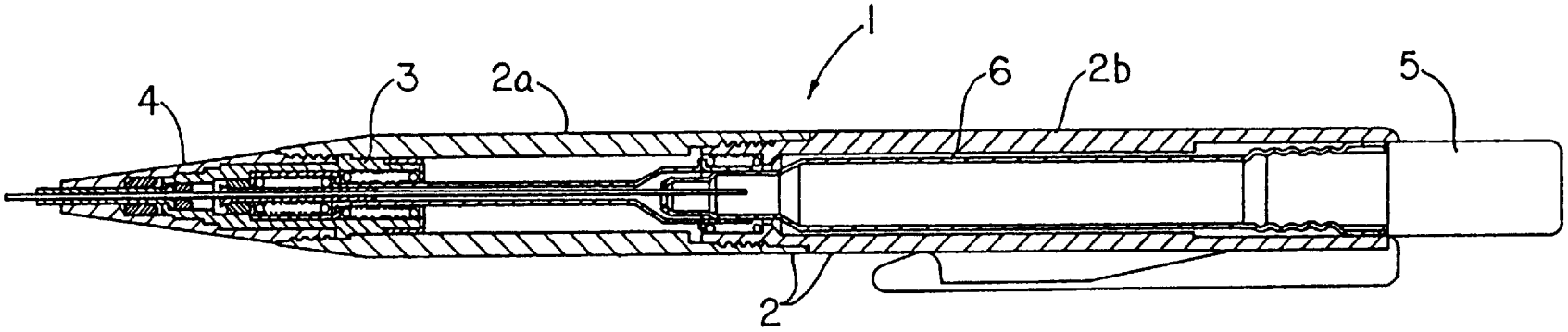
FIG. 1 is a cross-sectional view of a mechanical lead pencil structure.
Figure 2:
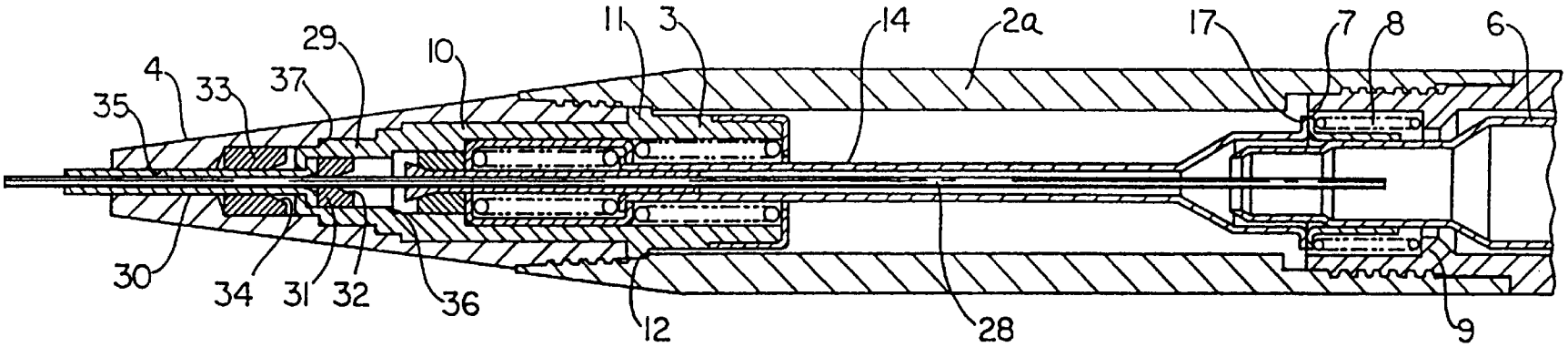
FIG. 2 is a cross-sectional view of the writing tip end of the pencil of FIG. 1, showing the mechanism in more detail; and, FIG. 3 is a cross-sectional view of a mechanism similar to that of FIGS. 1 and 2, however being constructed for a larger diameter pencil lead.
Figure 3:
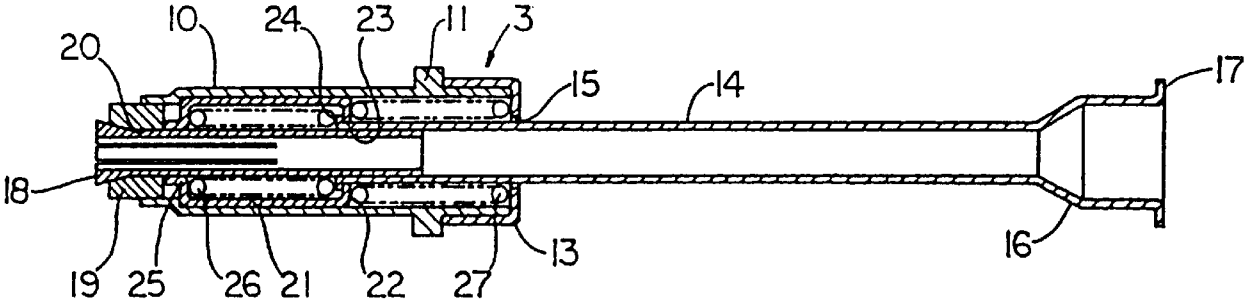

The mechanisms of FIGS. 1 and 2, and FIG. 3 are for pencil leads having diameters of say 0.2 mm and 2 mm respectively. The mechanisms are very similar in many respects and the following description is to be taken as applying to each mechanism, except where explicit reference is made to differences.

A mechanical pencil 1 has a barrel 2 which, in the example shown, consists of a lower portion 2*a* and an upper portion 2*b* which are screw-threaded together. A modular pencil mechanism 3 is contained primarily within the lower barrel portion 2*a*. As shown, the pencil 1 has a conical writing tip portion 4 which is screw-threaded into the lower end of the lower barrel portion 2*a*. At the opposite end of the pencil 1, a button 5 is connected to a lead chamber 6 which is contained within the upper barrel portion 2*b*. The lead chamber 6 has an external flange 7 at its end opposite the button 5 (FIG. 2). A weak compression spring 8 is disposed to function between the lead chamber flange 7 and an annular step 9 within the upper barrel portion 2*b*.

The modular pencil mechanism 3 further has an outer sleeve 10. The outer sleeve 10 is provided with an external flange 11 which, in the assembled pencil 1, is trapped against a step 12 in the lower barrel portion 2*a* by the conical writing tip 4. The mechanism outer sleeve 10 has a cap 13 disposed at one end thereof. A lead guide 14 is slidable within the outer sleeve 10 at its front portion, the rear portion of the lead guide 14 extending through an aperture 15 in the cap 13, rearwards of the mechanism. The rear end of the lead guide 14 flares outwards at a portion 16, and is terminated by a flange 17. When the mechanism 3 is secured within the pencil 1, the lead guide flange 17 acts against the flange 7 provided on the lead chamber 6, the flanges 7, 17 being urged together by the weak compression spring 8.

The end of the lead guide 14 within the mechanism sleeve 10 is rigidly connected to a clutch 18 which extends out of the opposite, front end of the mechanism sleeve 10. The clutch 18 is flared outwardly at its forwardmost free end. A clutch band 19 is fixed in the outer sleeve 10, the clutch band having a central aperture 20 through which the clutch 18 slides. The front end of the clutch band aperture 20 is flared or countersunk to receive the flared open end of the clutch 18.

An inner sleeve 21 is fitted within the outer sleeve 10 and is disposed around the clutch 18. At its rear end, the inner sleeve 21 has an end wall 22 with a central aperture 23 of a dimension which allows the lead guide 14 to be moved therethrough. The lead guide 14 has an outward flange 24 at its front end which is retained behind a wall 22 disposed on the inner sleeve 21 which prevents the lead guide 14 from passing completely out of the inner sleeve 21. At the front end of the inner sleeve 21 there is formed a necked portion 25 having the clutch 18 in sliding contact therewith, the neck portion 25 itself abutting against the clutch band 19. A coiled compression spring 26 acts between the neck portion 25 of the inner sleeve 21 and the front flange 24 on the lead guide 14 so as to urge the lead guide 14 in a rearward direction, and out of the outer sleeve 10.

A further coiled compression spring 27, which is weaker than the coiled compression spring 26 contained within the inner sleeve 21, acts between the cap 13 and the end wall 22 of thee inner sleeve 21.

In the mechanism 3 shown in FIG. 2, which is for a pencil lead 28 of diameter say 0.2 mm, the outer sleeve 10 has an extension 29 of the outer sleeve 10 and projects through the open end of the conical tip portion 4 in the assembled pencil 1. A rubber gripper 31 is fixed within the extension 29 of the outer sleeve 10, the rubber gripper 31 having a through aperture 32 in which the pencil lead 28 is a sliding fit.

In the example of the mechanism shown in FIG. 3, however, which is for a pencil lead having a larger diameter of say 2 mm, the extension 29, the close fitting lead guide 30, and the rubber gripper 31 are not necessary, and therefore not present. Instead, only a rubber gripper 33 having a through aperture 34 is provided in the conical tip 4 to grip the larger diameter pencil lead. The rubber gripper 33 is provided in both the small and larger pencil lead configurations, however when a larger lead is employed the extension 29, lead guide 30, and gripper 31 may be eliminated as the through bore 35 in the conical tip portion 4 through which the pencil lead moves is preferably of a diameter which enables the larger diameter pencil lead to be supported.

In operation, a user depresses the button 5 which urges the lead guide 14 forwards, and in turn pushes the clutch 18 forward. This operation also tends to carry the clutch band 19 forwards. In the mechanism shown in FIG. 2, for a relatively thin pencil lead 28, the clutch band 19 will travel until its movement is arrested by a step 36 formed within the extension 29 of the outer sleeve 10. With the mechanism for the relatively thick pencil lead shown in FIG. 3, the movement of the clutch band 19 is arrested by engagement of the clutch band 19 with a step 37 provided with the conical tip portion 4.

After the clutch band 19 has been stopped by either the step 36 in the extension 29 or the step 37 in the conical tip portion 4, further depression of the button 5 forces the clutch 18 out of the clutch band 19, thus releasing the grip of the clutch 18 on the pencil lead 28. At this point in the operation, the pencil lead 28 will extend out of the tip portion 4.

When the button is released, the clutch spring 26 urges the lead guide 14 rearwards, thus returning the button to its original rest position. This carries the clutch 18 backwards, but, at the same time, the pencil lead 28 is gripped by either the gripper 31 in the extension 29 for the thin lead or by the gripper 33 in the tip portion 4 for the thick lead. As the clutch 18 moves backward it picks up the clutch band 19, thus causing the clutch 18 to tighten around the pencil lead 28, preventing the pencil lead 28 from moving during the writing process. The cushioning spring 27 can absorb shocks during writing, which helps to prevent the pencil lead 28 being knocked rearwardly during the writing process since it allows the inner sleeve 21 and clutch 18 to move rearward slightly. The cushioning spring 27 also absorbs shocks if the pencil 1 is dropped during the writing process, with the pencil lead extended. The spring 8 acting against the flange 7 on the lead chamber 6 serves to keep the flanges 7 and 17 together.

In order to change one modular pencil mechanism 3 for another to accommodate a pencil lead having a different diameter, the user simply needs to unscrew the conical tip portion 4 from the lower portion 2*a* of the barrel 2, thus untrapping the outer flange 11 on the sleeve 10. The whole mechanism 3 can be removed as an integral unit since the clutch 18, the inner sleeve 21, and the clutch spring 26 and cushioning spring 27 are all contained within, or by, the outer sleeve 10 and cap 13. Similarly, the weak compression spring 8 is held within the pencil barrel 2 by the flange 7 on the lead chamber 6. Thus, it should be evident that there are no small loose components to be dealt with by the user during the lead changing process. The new mechanism can then simply be inserted into the lower barrel portion 2*a* and trapped there by screwing the conical tip portion 4 against the flange 11 within the lower barrel portion 2*a*.

While it is apparent that changes and modifications can be made within the spirit and scope of the present invention, it is my intention, however, only to be limited by the scope of the appended claims.

I claim:

1. A modular lead advancing mechanism for a writing instrument, characterized in that the modular advancing mechanism is receivable as an integral unit in a writing instrument and includes means for feeding a pencil lead from a writing instrument having the advancing mechanism contained therein, and force transmitting means for transmitting a force from an element of a writing instrument to operate said feeding means, the mechanism further including an outer sleeve having the lead feeding means disposed therein, said sleeve comprising an outwardly extending external flange forming a surface for supporting said mechanism in a writing instrument structure, the force transmitting means including lead guide means slidably movable within the outer sleeve, the means for feeding a pencil lead including a clutch fixed to or integral with the lead guide means and a clutch band disposed about said clutch, and in that resilient means is disposed between said clutch band and said lead guide means to tighten said clutch around a pencil lead when the lead is located in the clutch.

2. A modular lead advancing mechanism according to claim 1, characterized in that the resilient means is a coil spring.

3. A modular lead advancing mechanism for a writing instrument according to claim 1, characterized in that the outer sleeve is provided with an end cap disposed at the rear thereof and other resilient means located between said end cap and said lead feeding means for absorbing a force applied rearwardly to said lead feeding means.

4. A modular lead advancing mechanism according to claim 3, characterized in that the other resilient means is a coil spring.

5. A mechanical pencil including a barrel having an operative element disposed thereon and a removable portion at one end thereof forming an opening into said barrel, characterized by a modular lead advancing mechanism disposed within said barrel, said modular mechanism being insertable and removable as a unit through the end of said barrel with said barrel portion removed, said modular lead advancing mechanism including means for feeding a pencil lead from said barrel, and further characterized by force transmitting means for transmitting a force from said operative element to said lead feeding means.

6. A mechanical pencil according to claim 5, characterized in that the removable portion of said barrel is disposed at the forward end thereof and has an opening formed therein through which said lead is fed.

7. A mechanical pencil according to claim 5, characterized in that the operative element comprises a button disposed at the opposite end of said barrel from said removable portion.

8. A mechanical pencil according to claim 5, characterized in that the mechanism further comprises an outer sleeve having said lead feeding means disposed therein, said sleeve comprising an outwardly extending external flange and said barrel comprises an internal bearing surface for contacting said flange.

9. A mechanical pencil according to claim 8, characterized in that the force transmitting means comprises lead guide means slidably movable within the outer sleeve.

* * * * *